US006367781B1

(12) United States Patent
Flynn et al.

(10) Patent No.: US 6,367,781 B1
(45) Date of Patent: Apr. 9, 2002

(54) BARRIER MATERIAL, APPARATUS, AND METHOD

(75) Inventors: Charles D. Flynn, Deerbrook; Zoltan Ezer, Antigo, both of WI (US)

(73) Assignee: Plaspack USA, Inc., Antigo, WI (US)

( * ) Notice: Subject to any disclaimer, the term of this patent is extended or adjusted under 35 U.S.C. 154(b) by 0 days.

(21) Appl. No.: 09/501,440

(22) Filed: Feb. 10, 2000

(51) Int. Cl.[7] ..... E02B 15/06
(52) U.S. Cl. ..... 256/45
(58) Field of Search ..... 256/45, 46

(56) References Cited

U.S. PATENT DOCUMENTS

| | | | | |
|---|---|---|---|---|
| 2,709,073 A | | 5/1955 | Dougherty | |
| 3,186,893 A | | 6/1965 | Mercer | |
| 3,940,114 A | | 2/1976 | Rivelli | |
| 4,248,547 A | | 2/1981 | Brown | |
| 4,333,726 A | | 6/1982 | Fuxelius | |
| 4,728,080 A | * | 3/1988 | Kurschner et al. | 256/45 X |
| 4,905,969 A | * | 3/1990 | Kurschner et al. | 256/45 |
| 5,029,819 A | | 7/1991 | Kane | |
| 5,033,719 A | | 7/1991 | Cardente | |
| 5,267,813 A | | 12/1993 | Neal | |
| 5,407,178 A | * | 4/1995 | Long | 256/45 |
| 5,709,428 A | * | 1/1998 | Hugghins | 297/16.2 |
| 5,865,427 A | * | 2/1999 | Cowan | 256/19 |
| 6,035,875 A | * | 3/2000 | Chen | 135/88.07 |

* cited by examiner

*Primary Examiner*—Lynne H. Browne
*Assistant Examiner*—John Cottingham
(74) *Attorney, Agent, or Firm*—Merchant & Gould P.C.

(57) ABSTRACT

The a barrier material, a barrier apparatus and a method for making the barrier material. In one respect, a double knit barrier material including pockets in which barrier supports may be inserted to create a barrier apparatus. The barrier material provides for a barrier which can be easily constructed in a short period of time by providing for a quick, easy, and uncomplicated way to secure the barrier material to the barrier supports by simply inserting barrier supports into pockets in the barrier material.

21 Claims, 6 Drawing Sheets

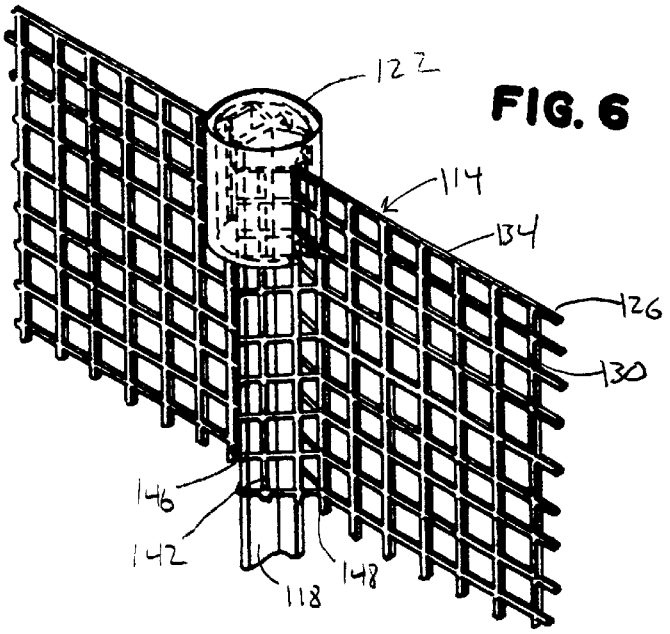
FIG. 6
FIG. 7
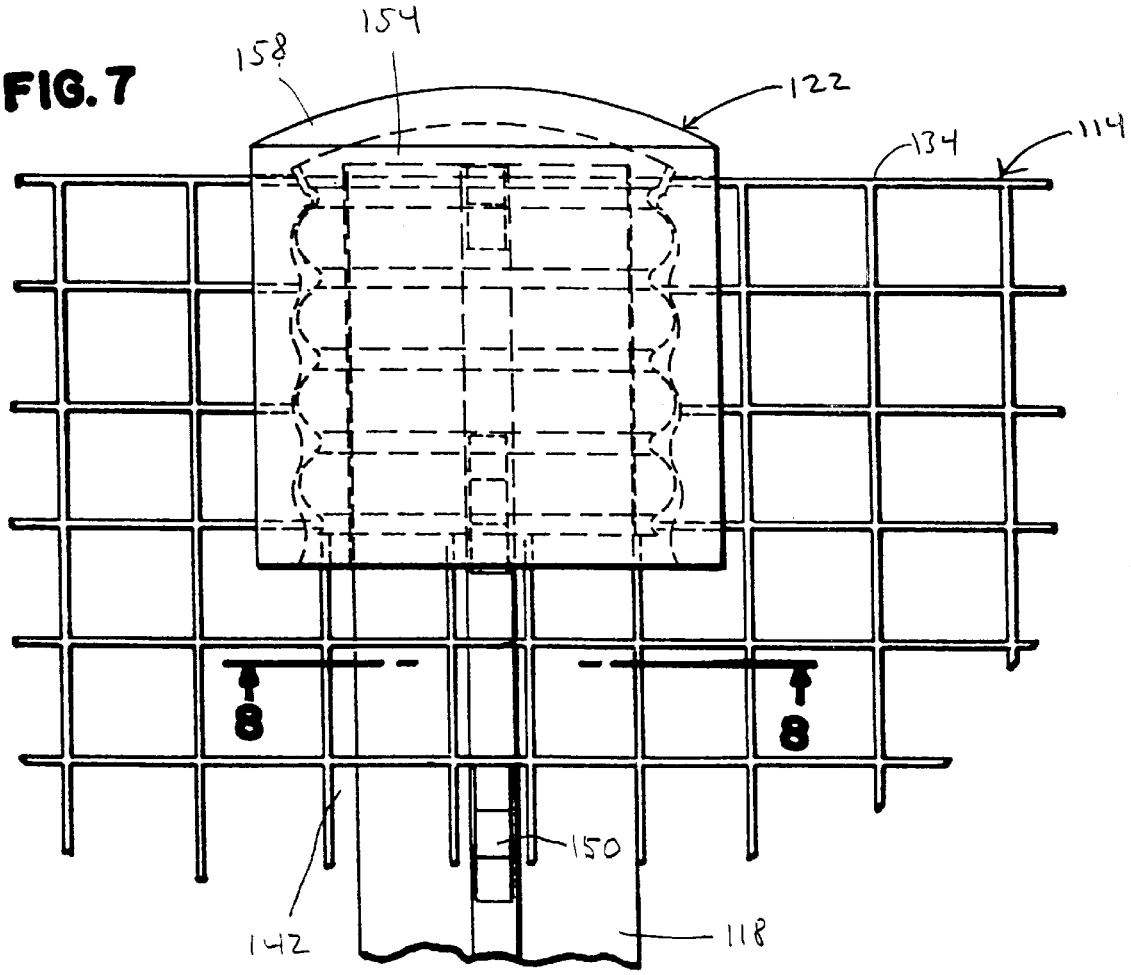

FIG. 11
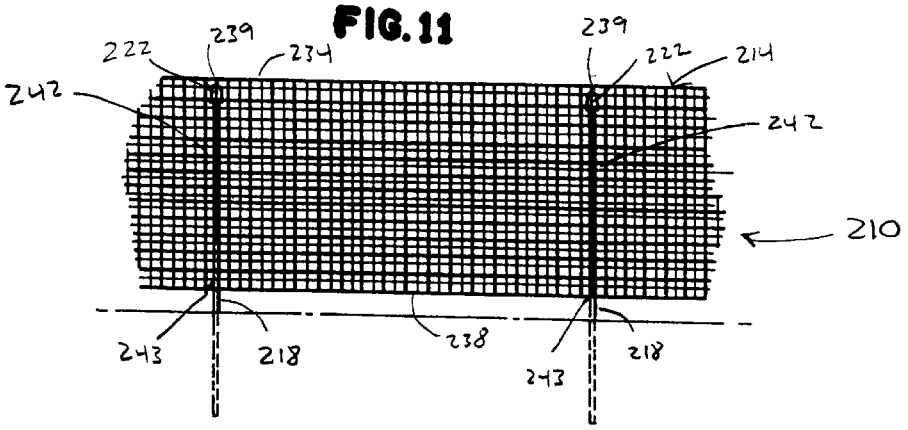
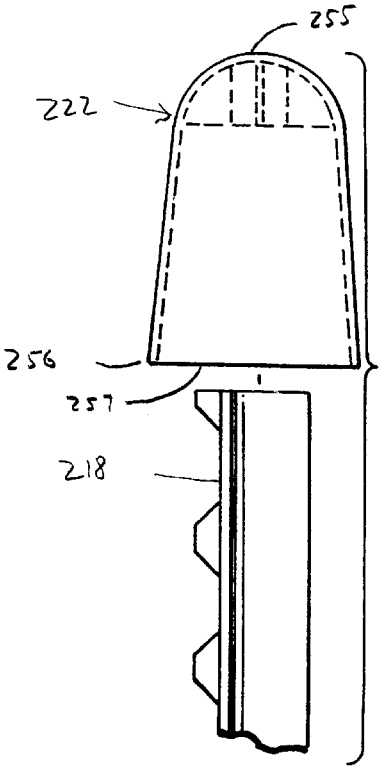
FIG. 12
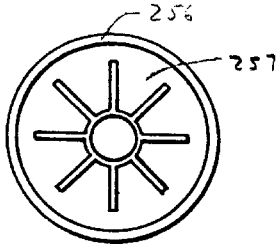
FIG. 13
FIG. 14
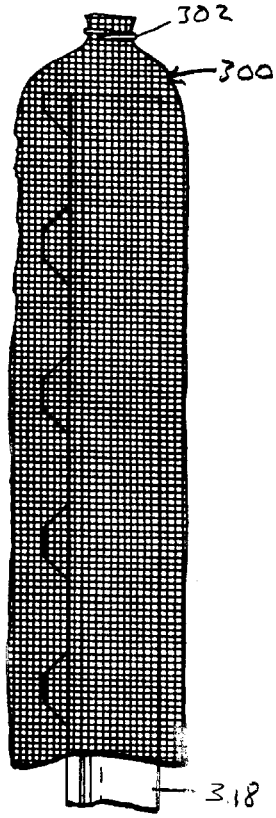

BARRIER MATERIAL, APPARATUS, AND METHOD

FIELD OF THE INVENTION

The invention generally relates to barriers. More particularly, the invention relates to a double knit barrier material having integral pockets, a barrier apparatus and a method for making the barrier material.

BACKGROUND OF THE INVENTION

It is generally known to provide a fence or fencing apparatus for the construction of portable or temporary fences. Such fences or barriers are often used as safety barriers on construction sites, as crowd control devices, as snow fences, as ski trail markings, or in a broad variety of other generally known applications.

A problem with many fences and fencing systems is that they are relatively burdensome or time consuming to construct. Many existing fence products are difficult to erect and more difficult to keep erect. One particularly problematic aspect of constructing many such fences is attaching the fence material to the fence posts. Separate attachment mechanisms or fasteners, such as separate ties, clips or wires, are often used to attach the fence material to the fence posts. Such attachment mechanisms are often troublesome and time consuming to use. It would be desirable to provide for an easier way of attaching the fencing material to the fence posts.

Additionally, it would be desirable to provide a fencing material including a mechanism or structure for attaching the fence material to the fence posts which is easy and relatively inexpensive to produce.

Therefore, there is a continuing need for a fence or barrier material, apparatus and method that facilitates the easy and timely construction of fences or other barriers.

SUMMARY OF THE INVENTION

The inventors have developed a barrier material including integral pockets in which barrier supports may be inserted to create a barrier apparatus. The barrier material provides for a barrier that can be easily constructed in a short period of time by providing for a quick, easy, and uncomplicated way to secure the barrier material to the barrier supports by simply inserting barrier supports into pockets within the barrier material.

In one aspect, the invention is related to a barrier material having a single ply of double-knit fabric having a first edge and a second edge. One or more pockets are formed in the fabric by the separation of the single ply of double-knit fabric at bounded areas into two separate single plies of single knit fabric. The pockets extend from the first edge toward the second edge of the fabric. In at least some embodiments, the pockets extend generally vertically within the material. In at least some other embodiments, the pockets extend generally horizontally within the material. Still other embodiments include pockets that extend both horizontally and vertically within the material.

The barrier material can be used in a broad variety of applications. For example, rigid, semi-rigid, or flexible barrier support members, such as rigid, semi-rigid or flexible fence posts or poles or other such supports can be inserted into the integral pockets within the fabric to construct a barrier apparatus. Additionally, flexible barrier support members, such as rope, cable, cordage, or other such structure can be inserted into the pockets as the support members.

The barrier material can be used, for example, in barricade fencing, snow fencing, crowd control fencing, animal control fencing, construction site fencing, protective or decorative netting, trellises, canopies, arbors and a broad variety of other such structures and applications. The barrier material can also be hung and used as a netting barrier, for example, safety or debris netting.

In another aspect, the invention relates to a barrier apparatus. The barrier apparatus includes the barrier fabric as discussed above having two or more pockets. The apparatus further includes two or more barrier supports, wherein each one of the barrier supports is disposed within a separate pocket in the barrier fabric to form the barrier apparatus.

In another aspect, the invention relates to a method of making a barrier material having one or more integral pockets therein. The method includes the steps of producing a single ply of double-knit fabric having a first edge and a second edge; and during the production of the single ply of double-knit fabric, forming one or more pockets in the double-knit fabric by allowing the separation of the single ply of double-knit fabric at bounded areas into two separate single plies of single knit fabric such that the pockets extend from the first edge toward the second edge of the fabric.

BRIEF DESCRIPTION OF THE DRAWINGS

FIG. 6 is a partial perspective view of the barrier apparatus shown in FIG. 5, with the interior portions of the barrier post cap shown in phantom.

FIG. 7 is a close-up side view of the barrier apparatus shown in FIG. 5, showing the interior portions of the barrier post cap in phantom.

FIG. 11 is a partial side view of a barrier apparatus including a barrier material embodying the invention.

FIG. 12 is an exploded partial side view of a fence post and fence post cap of the barrier apparatus in FIG. 11.

FIG. 13 is a partial cross sectional view of the fence post cap shown in FIG. 12.

FIG. 14 is a side view of a fence post having one embodiment of a protective sleeve thereon.

DETAILED DESCRIPTION OF THE PREFERRED EMBODIMENTS

In at least one respect, the invention relates to a barrier material including a single ply of double knit barrier fabric, wherein at bounded areas, one or more pockets are formed in the fabric by the separation of the single ply of double knit fabric into two plies of single knit fabric.

Figure 1:
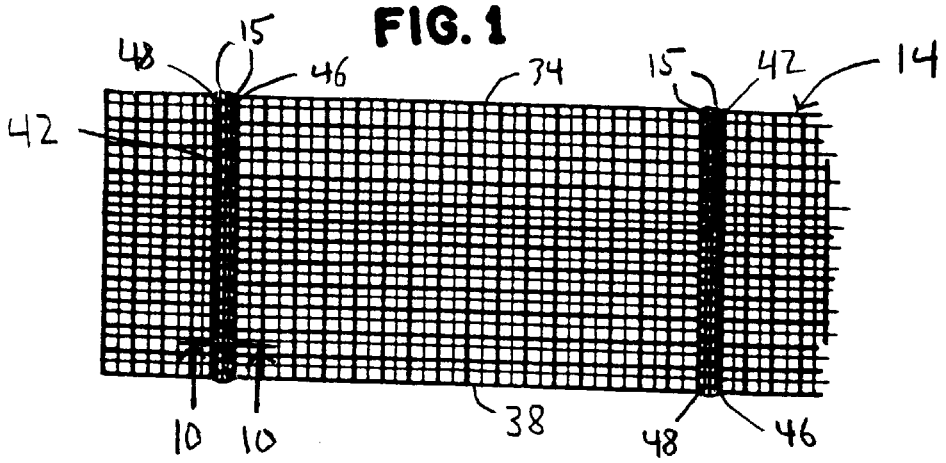
FIG. 1 is a partial side view of a barrier material embodying the invention.
Figure 2:
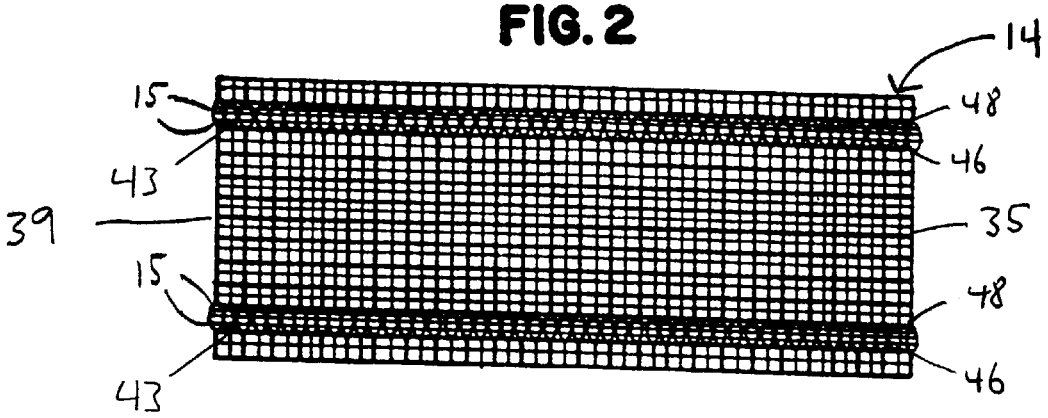
FIG. 2 is a partial side view of another barrier material embodying the invention.
Figure 3:
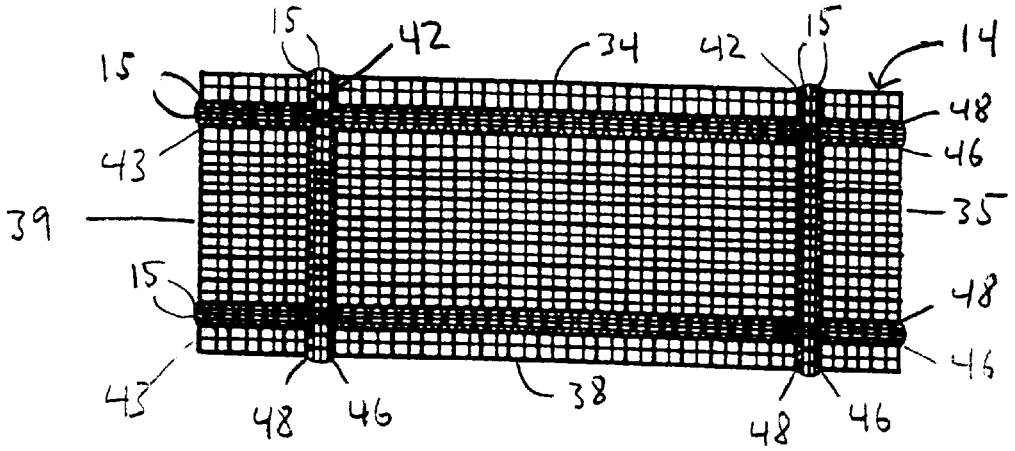
FIG. 3 is a partial side view of another barrier material embodying the invention.

Reference is first made to FIGS. 1, 2, and 3. Each of these three figures shows a different embodiment of a double knit barrier fabric 14, and like reference numerals represent like parts throughout the several views. In each embodiment, one or more vertical pockets 42 or horizontal pockets 43 are formed in the fabric 14. In FIG. 1, the pockets 42 extend generally vertically within the fabric 14. In FIG. 2, the pockets 43 extend generally horizontally within the fabric. The embodiment shown in FIG. 3 includes both vertical pockets 42 and horizontal pockets 43.

Figure 10:
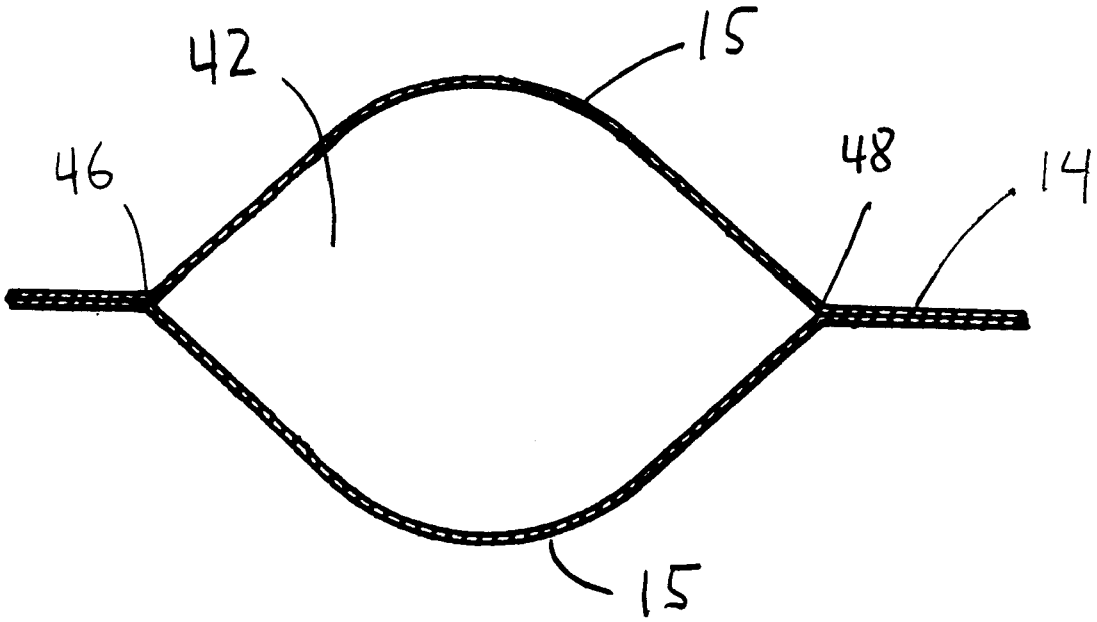
FIG. 10 is a partial cross sectional view taken along line 10—10 of FIG. 1.

The pockets 42 and 43 in each of these embodiments are formed by the separation of the material of the double knit fabric 14 at bounded areas to form two separate plies of single knit fabric 15. Referring to FIG. 10, which is a partial cross sectional view along line 10—10 of FIG. 1, the separation of the double knit fabric 14 into two single plies of single knit fabric 15 is clearly shown.

The pockets 42 and 43 allow for a quick, easy, and uncomplicated way to secure the barrier fabric 14 to barrier supports by simply inserting barrier supports into the pockets 42 and 43 in the barrier fabric 14. In some embodiments, the pockets extend only to one edge of the fabric. In other embodiments, the pockets extend from a first edge of the fabric to a second edge of the fabric. Any suitable barrier supports can be inserted into the pockets to construct a barrier apparatus using the compound barrier material.

Referring now to the specific structure of the embodiment shown in FIG. 1, the double knit fabric 14 includes a first horizontal edge 34 and a second horizontal edge 38, and the pockets 42 extend substantially vertically from the edge 34 to the edge 38. Preferably, the edges 34 and 38 are selvages, which are finished edges so as to prevent raveling or fraying of the fabric 14. The pockets 42 include sides 46 and 48 which at least partially define the boundaries of the bounded areas in which the pockets 42 exist. Preferably, the sides 46 and 48 of each pocket 42 are substantially parallel with one another extending from the upper edge 34 to the lower edge 38, but it is contemplated, that in some embodiments, the sides 46 and 48 of each pocket 42 will not be substantially parallel. It is preferable that the sides 46 and 48 of each pocket 42 are substantially perpendicular to the edges 34 and 38, but it is contemplated that in some embodiments, the sides 46 and 48 of each pocket 42 will not be substantially perpendicular to the edges 34 and 38.

In the embodiment shown in FIG. 2, the fabric 14 includes a side edge 35 and a side edge 39, and pockets 43 extend substantially horizontally from the side edge 35 to the side edge 39. The pockets 43 also include sides 46 and 48 which at least partially define the boundaries of the bounded areas in which the pockets 43 exist. Preferably, the sides 46 and 48 of each pocket 43 are substantially parallel with one another extending from the side edge 35 to the side edge 39, but it is contemplated, that in some embodiments, the sides 46 and 48 of each pocket 43 will not be substantially parallel.

Referring now to the specific structure of the embodiment shown in FIG. 3, the fabric 14 includes pockets 42 that extend substantially vertically from the horizontal edge 34 to the horizontal edge 38 as in the first embodiment, and also includes pockets 43 that extend substantially horizontally from the side edge 35 to the side edge 39 as in the second embodiment.

Although it is not necessary, when the fabric 14 includes more than one vertical pocket 42 and/or more than one horizontal pocket 43, it is preferred that, the vertical pockets extend substantially parallel to one another, and the horizontal pockets extend substantially parallel to one another. For examples, in FIGS. 1 and 3, pockets 42 extend substantially parallel to one another in a substantially vertical manner. Likewise, in FIGS. 2 and 3, pockets 43 extend substantially parallel to one another in a horizontal manner.

Such substantially parallel extending sets of pockets are preferably spaced from one another at predetermined distances within the barrier fabric 14. The spacing distance between the pockets may vary widely, depending upon the barrier application for which the particular barrier fabric 14 is designed. Therefore, there is no particular limitation upon the spacing that is possible between pockets, other than limitations necessary for the functionality of the barrier for a particular purpose.

In at least some embodiments, the substantially parallel extending pockets can be spaced in the range of about one inch to about thirty feet apart. In some particular embodiments, the parallel extending pockets are spaced in the range of about six to about eighteen inches apart.

The pockets 42 and 43 are of a width, from side 46 to side 48, such that they can be opened to have a cross-sectional area sufficient to accommodate particular barrier supports that are being used to construct a barrier apparatus. Preferably, the pockets have a cross-sectional area at any point along the length of each pocket that is greater than the cross-sectional area of the barrier supports that are contemplated for use. In some examples, the pockets are in the range of about two to about five inches wide, although larger or smaller widths are contemplated.

In constructing a barrier apparatus using the barrier fabric 14, a barrier support does not necessarily need to be inserted into every one of the pockets 42 or 43 in a particular barrier fabric 14. In some situations, one or more pockets within the fabric may be skipped, thereby leaving one or more empty pockets between the barrier supports. The number of pockets within a particular piece of fabric may vary from one to as many as will fit within a particular length or width of the fabric.

The fabric 14 may be either permeable or substantially impermeable to airflow. For some applications, it is preferred that the fabric 14 be permeable to airflow. For example, in many outdoor barrier applications, an air permeable fabric is preferred so that wind may flow through the barrier fabric to prevent the sail effect, wherein the barrier catches the wind and is undesirably blown by the wind. In some embodiments, the fabric 14 is permeable to liquid, such as water.

Figure 4:
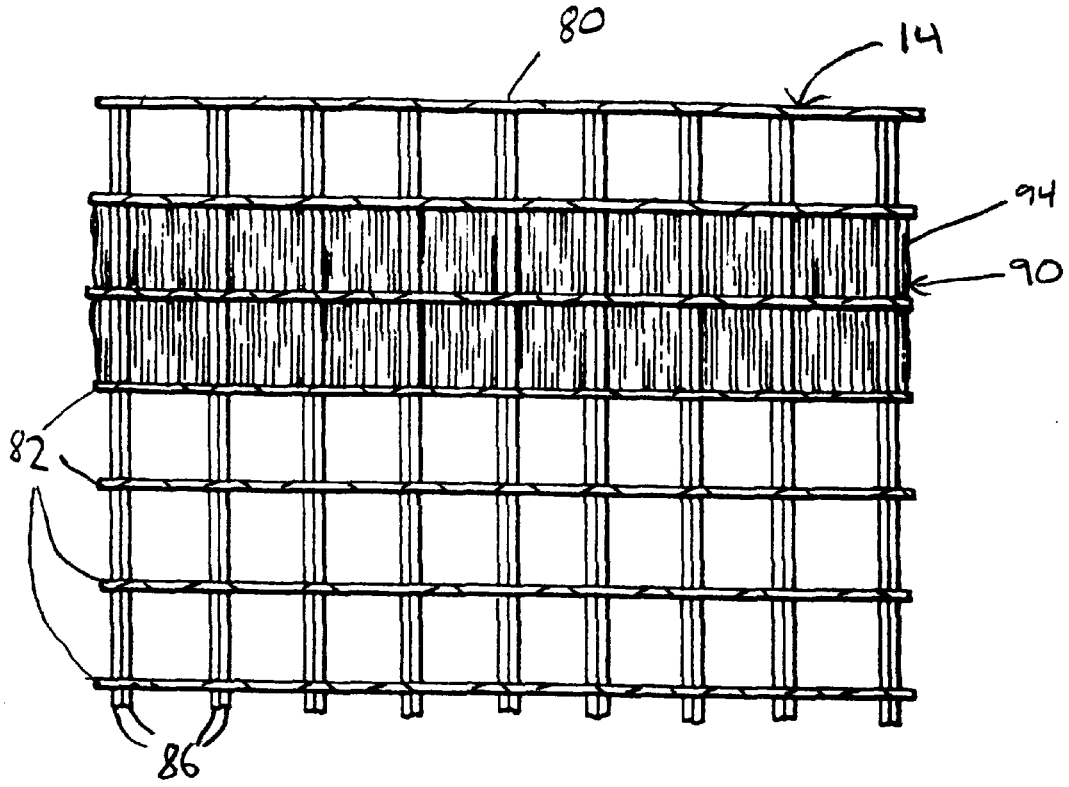
FIG. 4 is a partial side view of another barrier material embodying the invention.

Referring to FIG. 4, one suitable embodiment of an air permeable barrier fabric 14 includes a double knit mesh fabric 80. The double knit mesh fabric 80 is made up of a plurality of warps or warp knitted strings 82 oriented in one direction and being substantially equally spaced from one another. Weft filaments 86 are oriented in a second direction substantially perpendicular to the first direction, and interconnect the warps 82. The weft filaments 86 are guided into and made part of a warp knitted chain 82 for a defined number of cycles or courses, after which, a continuation of the same weft filaments 86 are guided into and made part of the an adjacent warp knitted chain 82 for one or more cycles or courses. The continuation of the same weft filaments 86 is then returned to the initial warp chain 82, and the pattern continues repeatedly to link the warp chains 82 by the weft filaments 86 to form a width of fabric out of the plurality of individual warps 82. These are commonly known in the knitting art as "daisy chains". Only one side of the double knit fabric 14 is clearly visible in the side view of FIG. 4 because the second side is joined to the back of and is generally a mirror image of the first side.

A compound knitting machine, having two or more synchronized lower warp knitting elements or needle bars installed parallel and back to back, can be used to form the single ply of double knit mesh fabric 14 that separates at bounded areas to form the integral pockets therein that extend generally perpendicular to the warps. In one example, as will be understood by a skilled artisan, a typical such knitting machine has two lower knitting elements or needle bars. The lower knitting elements consist of a series of latch needles, spaced laterally along a single plain, attached to a rail collectively called the needle bar. This assembly normally travels in a single plain, up and down motion. With each up stroke of the needle bar, the latch opens. If a single filament is looped around the open latch needle in an elliptical swinging motion, with the down stroke of the needle bar, the latch closes and a knot (half-hitch or daisy chain) is formed. It takes a single guide bar above to loop this filament around the latch needle. This forms the warp 82. A second upper element or guide bar in normally used to lay in the second filament of weft 86. This is a compound motion which not only incorporates the weft 86 with the warp 82, but also moves the weft 86 between warps 82 to form the knit fabric. Machines are available with up to twelve guide bars for each needle bar. Each guide bar can have a totally different swing pattern, totally different needle spacing and/or totally different filament source.

To form a double-knit fabric 14, the two knitting elements are separated sufficiently to enable the formation of individual warp knitted chains on each element, but close enough to enable the upper elements or guide bars to lay in one or more warp filaments into the warp chain being formed by one or more of the needle bars, thereby forming a double-knit, integrally connected fabric, or, when desired to make the pockets, two separated plies of single knit fabric, as is determined by the motion of the upper elements. Therefore, two plies of fabric can be produced simultaneously and face to face on certain compound textile production machines. The yams or filaments can be traversed back and forth between the facing plies of fabric on these compound machines, thereby linking multiple plies into a single ply of compound fabric.

Similar machines and methods can be used to produce tufted or plied fabrics, for example artificial fur. Additionally, such machines can be used, for example, in joining two plies of warp knitted mesh fabric in the production of seams in produce bags.

However, the inventor has devised producing a barrier material by making a double-knit fabric that is a single ply of double knit fabric for most of its length and width, while intermittently allowing the double knit fabric to separate into two plies of single knit fabric at brief intervals to create pockets within bounded areas. The non-joining of the two plies of single knit fabric allows the plies of the fabric to separate to form the pockets that extend generally perpendicular with the warps of the knitted fabric. Preferably, such pockets extend generally vertically within the material.

In some embodiments, the knitted mesh fabric has pockets that extend generally parallel with the warps of the knitted fabric. A fabric including such pockets can likewise be formed on a typical compound knitting machine. To create a pocket that extends generally parallel with the warps of the knitted fabric, both the warp and the weft filaments in the areas of the horizontal pockets are guided into the knitting needle bar by different guide bars, for which the motion or swing are programmed to engage only one of the lower needle bars, thus always creating two separated single plies of single knit fabric in that area, and therefore creating pockets. Preferably, such pockets extend generally horizontally within the material.

Suitable examples of knitting machines that can be used to produce the double knit fabric of the invention include double needle bar Raschel flat bed knitting machines manufactured by Mayer Textile Machine Corporation of Ubertshausen, Germany and Clifton N.J., under the model designations HDR-11-EHW-ST, RDS-11-FSM, and RDS-11. However, those of skill in the art will recognise that the invention could be achieved using similar knitting machines made by other manufacturers.

The barrier fabric 14 can be made of a wide variety of air permeable or non-air permeable materials generally known in the art to be suitable as barrier fabric or materials. For example, the barrier fabric 14 can be made of plastic, metal, natural fibers, or other fabric or materials generally known for use in barrier applications. Specifically suitable materials may include: high density polyethylene, polypropylene, polyester, nylon, and fiberglass. Preferably, such materials are in filament form, such as in flat tape, oval or round monofilament form, and are knitted into a fabric. The fabric is then used to create the barrier material. These fabrics are particularly suitable for producing a knitted mesh fabric. Most preferably, the barrier fabric is made out of high density polyethylene filaments knitted into a double knit mesh fabric having the pockets therein by the separation of the double knit fabric into two single plies of single knit fabric at select intervals..

The barrier fabric 14 can be any color desirable, dependent only upon the application for which it is being used, and limited by the colors available for the particular fabric or material used. In some applications it is desirable to make the barrier fabric clearly visible, so bright colors such as orange, yellow, metallic, or other such colors may be used. In some embodiments, it may also be desirable to add an especially colorful or reflective portion to the barrier fabric to increase the fabric's visibility. For example, a reflective material may be integrated into the barrier fabric. In the particular embodiment shown in FIG. 4, reflective portions 90 are shown as being integral with at least one portion of the barrier fabric 14. Specifically, a plurality of metallic reflective wefts 94 are strung between pairs of the warps 82 to produce reflective portions which are integral with the fabric.

The double knit barrier fabric can be used in a broad variety of useful barrier applications. For example, rigid, semi-rigid, or flexible barrier support members, such as rigid, semi-rigid or flexible fence posts, can be inserted into the pockets within the fabric and used to construct fencing apparatus, such as barricade fencing, snow fencing, crowd control fencing, animal control fencing, protective or decorative nets, trellises, canopies, arbors and a broad variety of other such structures and applications. Such barrier supports can be made of any material generally useful as a barrier support, such as: metal, wood, plastic and other polymers, bamboo, and the like. Additionally, flexible barrier support members, such as rope, cable, cordage, or other such structures can be inserted into the pockets such that the barrier material can be hung and used as a netting barrier, such as safety or debris netting.

Some specific examples depicting different embodiments and possible uses of the barrier material will now be described.

FIGS. 5–9 show one specific example of a portion of a barrier apparatus 110 constructed using one embodiment of double knit barrier fabric 114. The barrier apparatus 110 comprises a barrier fabric 114, and barrier supports 118. The barrier apparatus 110 may also optionally include barrier support caps 122.

The barrier fabric 114 used in the barrier apparatus 110 is substantially similar to the barrier fabric 14 of the first embodiment shown in FIG. 1, and described above. The fabric 114 includes an upper horizontal edge, preferably a selvage 134 and a lower horizontal edge, preferably a selvage 138, and one or more pockets 142 that extend from the selvage 134 to the selvage 138. The pockets 142 include sides 146 and 148 which at least partially define the boundaries of the bounded areas in which the pockets 142 exist. Preferably, the sides 146 and 148 of each pocket 142 are substantially parallel with one another extending from the upper selvage 134 to the lower selvage 138, but it is contemplated, that in some embodiments, the sides 146 and 148 of each pocket 142 will not be substantially parallel. It is preferable that the sides 146 and 148 of each pocket 142 are substantially perpendicular to the upper and lower selvages 134 and 138.

Figure 5:
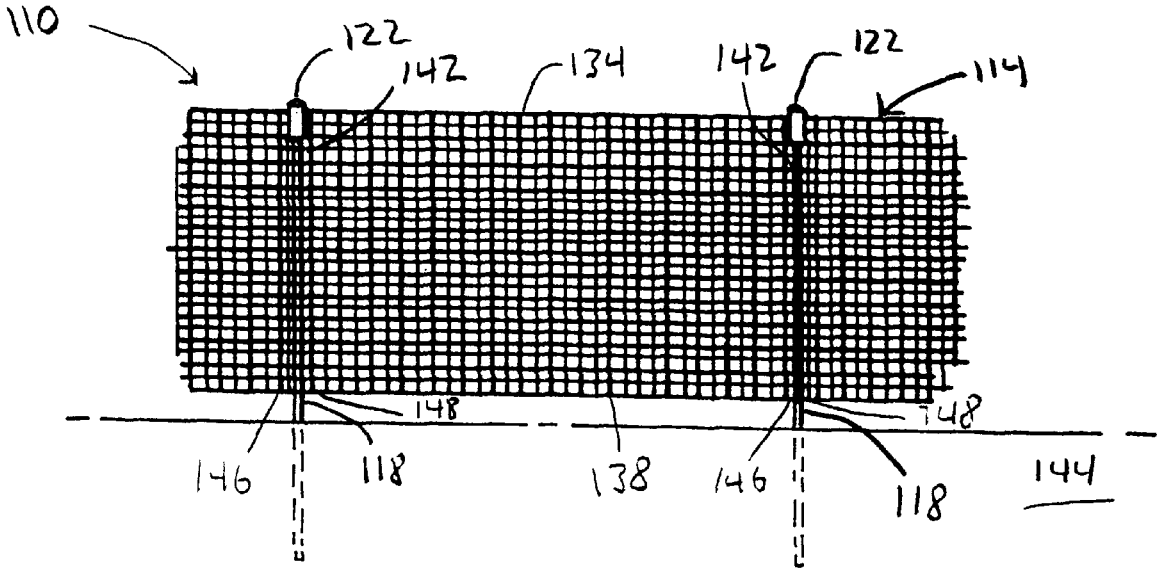
FIG. 5 is a partial side view a barrier apparatus including a barrier material embodying the invention.

As shown in FIG. 5, barrier supports 118, which in this embodiment are fence posts 118, are inserted into and extend within pockets 142 to form the barrier apparatus 110. The barrier supports 118 extend the full length of the pockets 142, and preferably, beyond the lower selvage 138 of the barrier fabric 114. The fence posts 118 then extend into the ground 144.

The barrier supports 118 generally can be any elongated member generally known as usable as a barrier support, and which will fit within the particular pockets of the barrier fabric being used. Therefore, at least a portion of the barrier supports 118 have a cross-sectional area which is smaller than the cross-sectional area of the pockets of the particular fabric being used. The particular barrier supports 118 shown are fence posts that are generally T-shaped in cross section (FIG. 8), but it should be understood that the invention is not limited to such fence posts, and most known barrier supports will work. Preferably, the fence posts 118 include one or more friction producing members or edges which facilitate the maintenance of the barrier fabric 114 onto the fence post 118. Friction producing members may include protrusions, hooks, or other such structures. For example, referring to FIGS. 7, 8, and 9, one style of fence post 118 includes at least one protrusion 150 off of at least one side of the fence post 118. As seen in FIG. 7, these protrusions 150 interact with the barrier fabric 114, and help to maintain the barrier fabric 114 on the fence post 118.

Figure 8:
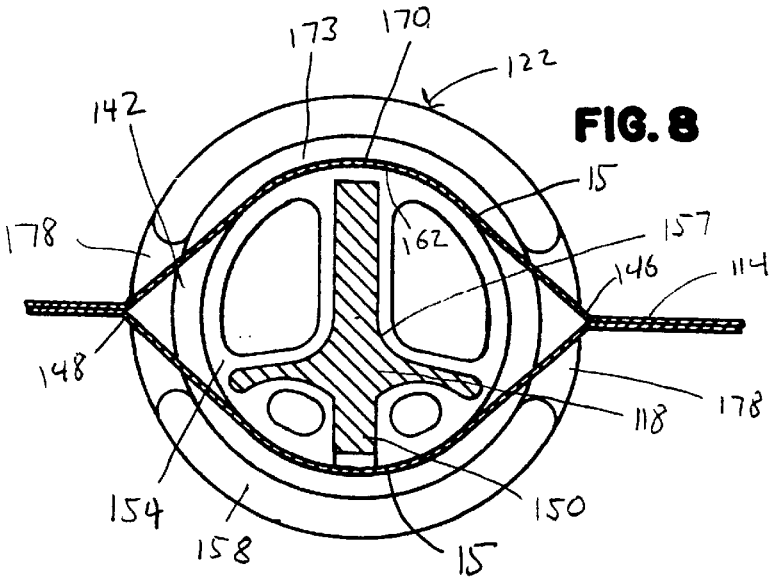
FIG. 8 is a partial cross sectional view taken along line 8—8 of FIG. 7.
Figure 9:
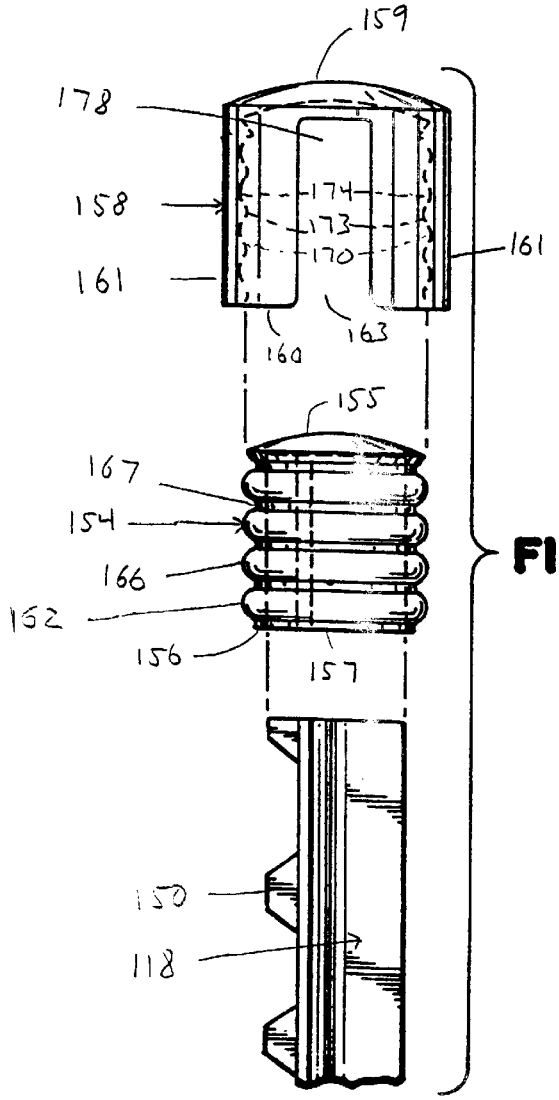
FIG. 9 is an exploded view of the barrier post cap and barrier post of FIG. 8.

The barrier apparatus 110 can also optionally include fence post caps 122 which aid in maintaining the barrier fabric 114 on the fence posts 118. It should be understood that many designs, shapes and sizes of fence post caps are contemplated, and that the invention is not limited to any particular fence post cap. Referring to FIGS. 7, 8, and 9 one particular fence post cap 122 is shown. The fence post cap 122 includes an inner member 154 and an outer member 158. Referring to FIG. 9, the inner member 154 includes a top 155, a bottom 156, and at least one opening 157 in the bottom 156 adapted to accept a top portion of a fence post 118 so that the cap 122 can be maintained on top of the fence post 118. The opening 157 is generally T-shaped in cross section such that the opening can house the generally T-shaped top of the fence post 118. The inner member 154 also includes an outward surface 162 having a plurality of ridges 166 and grooves 167 thereon. At least a portion of the inner member 154 adjacent to the bottom 156 has a cross-sectional area that is smaller than the cross-sectional area of the pockets 142, such that a portion of the inner member can fit within one of the pockets 142.

The outer member 158 is generally cup shaped and is adapted to fit over the top 155 of the inner member 154. The outer member 158 includes a top 159, a bottom 160, sides 161, and at least one cavity 163 in the bottom 160. The cavity 163 is defined by the sides 161, and is adapted to accept and maintain at least a portion of the inner member 154. The sides 161 also define channels 178 which are formed in the sides 161. The sides 161 include inward surfaces 170 having a plurality of ridges 173 and grooves 174 thereon. The ridges 173 and grooves 174 are adapted to engage the ridges 166 and grooves 167 when the outer member 158 is placed over the inner member 154.

As shown in FIG. 8, the fence post caps 122 are adapted such that a portion of the inner member 154 can fit within a pocket 142 such that the single plies of single knit fabric 15 that form the pockets 142 in the double knit barrier material 114 surrounds a portion of the inner member 154. The outer member 158 fits over the top of the inner member 154 such that a portion of the single plies of single knit fabric 15 are maintained between the outward surface 162 of the inner member 154, and the inward surfaces 170 of the outer member 158. The barrier post caps 122 thereby aid in maintaining the barrier material 114 on the fence posts 118. The side channels 178 allow the barrier fabric 114 to extend freely from within the outer member 158 of the fence post cap 122 without bunching or deforming the upper edge 134 of the barrier fabric 114.

It has also been found in such embodiments that the inner member 154 of a fence post cap 122 can be helpful to avoid snagging while positioning a pocket 142 onto a barrier post 118. For example, the inner portion 154 of the fence post cap 122 is placed on top of a fence post 118. The pocket 142 is then slid onto the top of the inner member 154, and then down onto the fence post 118. The inner member 154 acts to spread the pocket 142 open, thus making it less susceptible to snagging on the protrusions 150 or other friction members of the fence post 118.

Those of ordinary skill in the art will recognize that there are many methods in which the barrier apparatus 110 can be constructed, and that the invention is not limited to any particular method. The barrier apparatus 110 can be installed using a method which generally includes the steps of: providing the barrier fabric 114 having pockets 142 therein, positioning a fence post 118 in a desired location for a barrier apparatus 110, and installing the barrier fabric 114 onto the fence post 118 by inserting at least a portion of the fence post 118 into at least a portion of one of the pockets 142. Thereafter, additional fence posts 118 are inserted into separate pockets 142 of the barrier material 114, the barrier material 114 is pulled relatively tight between the fence posts 118, and the additional fence posts 118 are positioned in the desired location for the barrier 110.

FIGS. 11–13 depict another embodiment of a fencing apparatus 210 wherein the barrier material 214 includes pockets 242 that do not extend entirely through the barrier fabric 214. The barrier apparatus 210 comprises a double knit barrier fabric 214 having integral pockets 242 therein, and barrier supports 218 within the pockets 242. The barrier apparatus 210 can also optionally include barrier support caps 222.

The barrier fabric 214 used in the barrier apparatus 210 is substantially similar to the barrier fabric 114 of the embodiment shown in FIGS. 5–11, in that it includes an first horizontal edge, preferably a selvage 234 and a second horizontal edge, preferably a selvage 238, and one or more pockets 242 that extend from the selvage 234 toward the selvage 238. However, the pockets 242 do not extend through selvage 234. Therefore, the pockets 242 have a first open end 243 near selvage 238, and have a closed second end 239 near selvage 234. As such, when barrier supports, such as fence posts 218, are inserted into the pockets 242 through the open end 243, and extend to the closed end 239, they are stopped at the closed end 239. The barrier fabric 214 is thereby at least partially maintained on the fence posts 218 by engagement of the fence post 218 with the closed end 239 of the pocket 242.

As disclosed above, the barrier apparatus 210 may also optionally include fence post caps 222 which fits over the end of the fence posts 218. Such a fence post cap 222 helps to avoid abrasion by the end of the fence post 218 upon the barrier fabric 214, and helps maintain the fence post with the pocket 242. Additionally, the fence post caps 222 aid in construction by acting to spread the pocket 242 open, thus making the pocket 242 less susceptible to snagging on the fence post 218 during insertion.

Referring to FIGS. 12 and 13, one particular fence post cap 222 is shown. The fence post cap 222 is generally cup shaped member that is adapted to fit over the end of a fence post 218. The cap 222 includes a top 255, a bottom 256, and at least one opening 257 in the bottom 256 adapted to accept the end of a fence post 218 so that the cap 222 can be maintained on the fence post 218. As shown in FIG. 11, the fence post cap 222 is adapted such that it sits on top of the fence post 218 within the pocket 242, and engages the closed end 239 of the pocket 242.

In some instances, the barrier supports may include rough surfaces or projections that may tend to abrade, snag, cut, fray, or otherwise damage the fabric of the fencing material, especially in high wind conditions. Referring now to FIG. 14, the inventor has developed another aspect of the invention disclosed herein, which entails the use of a sleeve 300 which is adapted to be placed over a barrier support member, such as a fence post 318, to help reduce such damage to the fabric. The sleeve 300 is generally tubular in shape, and should be of a size and length adapted to fit the particular type of barrier support member being used. The sleeve 300 is adapted to fit over the fence post 318, and the pocket of the material fits over the sleeve covered fence post 318.

The sleeve 300 can be made from a broad variety of materials suitable for such a use. For example, the sleeve 300 can be made of plastic, metal, natural fibers, or other fabric or materials generally known. The materials are formed into a sleeve using generally known methods, for example, knitting, weaving, extrusion, molding, sewing, and a broad variety of other generally known methods. Specifically suitable materials may include: high density polyethylene, polypropylene, polyester, nylon, and fiberglass. Preferably, such materials are in filament form, such as in flat tape, oval or round monofilament form, and are knitted or woven into a fabric to form the sleeve 300. Most preferably, the sleeve 300 is made out of high density polyethylene filaments knitted or woven into a mesh fabric. The fabric is formed into a tubular sleeve 300, and one end is closed by methods generally known, for example by gathering and binding with an adhesive, a clip, a hog ring, by sewing, or other such means. In the embodiment shown, the end is closed using a hog ring 302.

The above description and drawings provide a complete description of embodiments of the invention. Since many embodiments of the invention can be made without departing from the spirit and scope of the invention, the invention resides in the claims hereinafter appended.

We claim:

1. A barrier material comprising:

(a) a first ply of single-knit fabric;

(b) a second ply of single-knit fabric;

(i) said first ply of single-knit fabric and said second ply of single-knit fabric being joined together to form a double-knit fabric extension;

(A) said double-knit fabric extension having:

(1) a first edge along a length of the double-knit extension and an opposite second edge along the length of the double-knit extension.

(2) at least a first and a second bounded area along the double-knit extension;

(3) a first integral pocket formed between said first and said second bounded areas, the first integral pocket having a first pocket side and an opposing second pocket side extending between said first edge and said second edge;

(a) said first pocket side comprising said first ply of single-knit fabric;

(b) said second pocket side comprising said second ply of single-knit fabric; and (4) said first pocket side being selectively separable from said second pocket side to define a first interior area of the first integral pocket therein.

2. A barrier material according to claim 1 wherein:

(a) said first and second pocket sides of said first integral pocket extend completely between said first edge and said second edge.

3. A barrier material according to claim 1 further including:

(a) at least a third bounded area;

(b) at least a second integral pocket located between the third bounded area and another bounded area, the second integral pocket having a first and second opposing pocket sides extending between said first edge and said second edge;

(i) said first pocket side of said second integral pocket comprising said first ply of single-knit fabric;

(ii) said second pocket side of said second integral pocket comprising said second ply of single-knit fabric; and (iii) said first pocket side of said second integral pocket being selectively separable from said second pocket side of said second integral pocket to define a second interior area of the second integral pocket therein.

4. A barrier material according to claim 3 wherein:

(a) said double-knit fabric extension includes:

(i) a plurality of warps oriented in a first direction, and (ii) a plurality of weft filaments interconnecting the warps and being oriented in a second direction substantially perpendicular to the first direction.

5. A barrier material according to claim 4 wherein:

(a) at least one of said first and second integral pockets extends perpendicular to the warps.

6. A barrier material according to claim 4 wherein:

(a) at least one of said first and second integral pockets extends parallel to the warps.

7. A barrier material according to claim 1 wherein:

(a) said first integral pocket includes a first end defining an opening through the first edge of the double-knit fabric extension, and a second end defining an opening through the second edge of the double-knit fabric extension.

8. A barrier material according to claim 1 wherein:

(a) said first integral pocket includes a first end defining an opening through the first edge of the double-knit fabric extension and a second closed end.

9. A barrier material according to claim 1 wherein:

(a) at least a portion of the double-knit fabric extension includes a metallic light reflective material knitted therein.

10. A barrier apparatus comprising:

(a) a first ply of single-knit fabric;

(b) a second ply of single-knit fabric;

(i) said first ply of single-knit fabric and said second ply of single-knit fabric being joined together to form a double-knit fabric extension;

(A) said double-knit fabric extension having:

(1) a first edge along a length of the double-knit fabric extension and an opposite second edge along the length of the double-knit fabric extension;

(2) a first integral pocket; said first integral pocket including a first side and a second side; said first side being adjacent a first bounded region of said first ply of single-knit fabric and said second ply of single-knit fabric; said second side being adjacent a second bounded region of said first ply of single-ply fabric and said second ply of single-knit fabric.

a. said first integral pocket being defined by separation of said first ply of single-knit fabric from said second ply of single-knit fabric between said first side and said second side of the first integral pocket;

b. the first integral pocket extending from the first edge to the second edge of the double-knit fabric extension;

(3) a second integral pocket; said second integral pocket including a first side and a second side; said first side being adjacent the second bounded region of said first ply of single-knit fabric and said second ply of single-knit fabric; said second side being adjacent a third bounded region of said first ply of single-ply fabric and said second ply of single-knit fabric;

a. said second integral pocket being defined by separation of said first ply of single-knit fabric from said second ply of single-knit fabric between said first side and said second side of the second integral pocket;

b. the second integral pocket extending from the first edge to the second edge of the double-knit fabric extension;

(c) a plurality of barrier supports, including at least a first support and a second support;

(i) said first support being positioned within said first integral pocket; and (ii) said second support being positioned within said second integral pocket.

11. A barrier apparatus according to claim 10, wherein:

(a) said first and said second integral pockets are oriented parallel to one another.

12. A barrier apparatus according to claim 10, wherein:

(a) said first and second integral pockets include a first end defining an opening through the first edge of the double-knit fabric extension, and a second end defining an opening through the second edge of the double-knit fabric extension.

13. A barrier apparatus according to claim 12, wherein:

(a) said first barrier support extends through said first end of said first integral pocket toward said second end of said first integral pocket;

(b) said second barrier support extends through said first end of said second integral pocket toward said second end of said second integral pocket.

14. A barrier apparatus according to claim 13, wherein:

(a) the apparatus further comprises a plurality of support caps, including at least a first support cap and a second support cap each support cap including:

(i) an inner portion;

(ii) an outer portion; and (iii) channels formed in said outer portion;

(b) the first and second support caps respectively positioned over said first and second barrier supports so that the first and second plies of single-knit fabric are positioned between said inner portion and said outer portion of said support caps, the extension of double-knit fabric extending outward from the caps through said channels.

15. A barrier apparatus according to claim 10, wherein:

(a) said first and second integral pockets include a first end defining an opening through the first edge of the double-knit fabric extension, and a second end defining a closed end.

16. A barrier apparatus according to claim 15, wherein:

(a) said first barrier support extends through the first end of said first integral pocket toward the closed end of said first integral pocket;

(b) said second barrier support extends through the first end of said second integral pocket toward the closed end of said second integral pocket.

17. A method of making a barrier material having at least one integral pocket therein, the method comprising:

(a) producing a first ply of a single-knit fabric;

(b) producing a second ply of a single-knit fabric;

(c) binding the first ply aid the second ply of single-knit fabric to produce a first bounded region of double-knit fabric having a first selvage edge and a second selvage edge;

(d) binding the first ply and the second ply of single-knit fabric to produce a second bounded region of double-knit fabric having a first selvage edge and a second selvage edge;

(e) providing a non-bounded area between the first bounded region and the second bounded region;

(f) separating the double-knit fabric between the first bounded region and the second bounded region into two plies of single-knit fabric to form the integral pocket at the non-bounded area of the double-knit fabric, wherein the integral pocket extends from the first selvage edge toward the second selvage edge of the fabric.

18. The method of making a barrier material of claim 17, wherein:

(a) the first and second bounded regions define a length of double-knit fabric; and (b) the step of separating the double-knit fabric to form the integral pocket includes forming the integral pocket to extend generally perpendicular to the length of the double-knit fabric.

19. The method of making a barrier material of claim 17, wherein:

(a) the first and second bounded regions define a length of double-knit fabric; and (b) the step of separating the double-knit fabric to form the integral pocket includes forming the integral pocket to extend generally parallel to the length of the double-knit fabric.

20. The method of making a barrier material of claim 17, wherein the method includes the step of;

(a) binding a plurality of bounded regions; and (b) providing a plurality of non-bounded areas, the non-bounded areas defining a plurality of pockets wherein each pocket of the plurality is generally parallel to one another and spaced a distance from one another.

21. The method of making a barrier material of claim 17, wherein the method further includes:

(a) knitting a reflective material into at least a portion of the double-knit fabric to increase the visibility of the barrier material.

* * * * *

UNITED STATES PATENT AND TRADEMARK OFFICE

CERTIFICATE OF CORRECTION

PATENT NO. : 6,367,781 B1
DATED : April 9, 2002
INVENTOR(S) : Charles D. Flynn and Ezer Zoltan It is certified that error appears in the above-identified patent and that said Letters Patent is hereby corrected as shown below:

Title page,
Item [75], Inventors, "Zoltan Ezer" should read -- Ezer Zoltan --;

Column 5,
Line 38, "yams" should read -- yarns --.

Signed and Sealed this

Tenth Day of September, 2002

*Attest:*

*Attesting Officer*

JAMES E. ROGAN
*Director of the United States Patent and Trademark Office*